US011759937B1

(12) United States Patent
Chuan

(10) Patent No.: US 11,759,937 B1
(45) Date of Patent: Sep. 19, 2023

(54) AUTOMATIC OIL RETURN STRUCTURE FOR PISTON PUMP

(71) Applicant: KUDOS MECHANICAL CO., LTD., New Taipei (TW)

(72) Inventor: James Chuan, New Taipei (TW)

(73) Assignee: KUDOS MECHANICAL CO., LTD., New Taipei (TW)

( * ) Notice: Subject to any disclaimer, the term of this patent is extended or adjusted under 35 U.S.C. 154(b) by 0 days.

(21) Appl. No.: 18/055,244

(22) Filed: Nov. 14, 2022

(30) Foreign Application Priority Data

Aug. 31, 2022 (TW) ..... 111132812

(51) Int. Cl.
*B25F 5/00* (2006.01)
*F15B 11/15* (2006.01)
(Continued)

(52) U.S. Cl.
CPC ..... *B25F 5/005* (2013.01); *F15B 11/15* (2013.01); *F15B 13/021* (2013.01); *F15B 15/149* (2013.01); *F15B 15/1476* (2013.01); *H01R 43/0427* (2013.01); *B25B 5/061* (2013.01); *B25B 5/064* (2013.01); *B25B 5/087* (2013.01); *B25B 27/10* (2013.01); *F15B 2211/428* (2013.01); *F15B 2211/50518* (2013.01)

(58) Field of Classification Search
CPC ..... B25F 5/005; B25F 5/061; B25F 5/064; B25F 5/087; B25B 27/10; F15B 11/15; F15B 13/021; F15B 15/1476; F15B 15/149; F15B 2211/428; F15B 2211/50518; H01R 43/0427
See application file for complete search history.

(56) References Cited

U.S. PATENT DOCUMENTS 4,132,107 A * 1/1979 Suganuma ..... H01R 43/0427 72/416
4,226,110 A 10/1980 Suganuma
(Continued)

FOREIGN PATENT DOCUMENTS

AU 2013334470 5/2015
CN 2250441 Y 3/1997
(Continued)

*Primary Examiner* — Dustin T Nguyen
(74) *Attorney, Agent, or Firm* — Sinorica International Patent & Trdaemark

(57) ABSTRACT

An automatic oil return structure is provided. The automatic oil return structure has an oil storage bag, a piston, and a main body assembly. The piston has an oil storage chamber. The main body assembly has a main channel, a piston oil channel, a pressure regulating channel, a control channel, an operation channel, a minor channel, and an oil return channel. When the pressure of the main channel achieves a limit pressure, the pressure pushes the control blocking assembly away such that the pressure regulating channel communicates with the communication channel, and the pressure also pushes the operating assembly away such that the minor channel communicates with the return channel. At the same time, the pressure of the oil storage chamber pushes the oil blocking assembly, so as to isolate the oil storage chamber from the main channel, and the oil storage chamber communicates with the oil return channel.

17 Claims, 16 Drawing Sheets

(51) Int. Cl.

| | |
|---|---|
| ***F15B 15/14*** | (2006.01) |
| ***F15B 13/02*** | (2006.01) |
| ***H01R 43/042*** | (2006.01) |
| *B25B 5/06* | (2006.01) |
| *B25B 5/08* | (2006.01) |
| *B25B 27/10* | (2006.01) |

(56) References Cited

U.S. PATENT DOCUMENTS

| | | | | |
|---|---|---|---|---|
| 5,125,324 | A * | 6/1992 | Araki | B25B 7/126 269/238 |
| 6,276,186 | B1 * | 8/2001 | Frenken | B21J 15/26 29/751 |
| 6,564,610 | B2 * | 5/2003 | Lefavour | F15B 15/18 60/477 |
| 10,312,653 | B2 * | 6/2019 | Ballard | H01R 43/0427 |
| 2020/0147772 | A1 * | 5/2020 | Frenken | B25B 27/10 |

FOREIGN PATENT DOCUMENTS

| | | |
|---|---|---|
| CN | 103072124 | 5/2013 |
| DE | 4215972 | 11/1992 |
| DE | 102014226033 | 6/2015 |
| DE | 112012000630 | 5/2018 |
| DE | 102020112217 | 5/2021 |
| JP | 2003247502 | 9/2003 |
| TW | 453406 U | 9/2001 |
| TW | I717112 | 1/2021 |

* cited by examiner

AUTOMATIC OIL RETURN STRUCTURE FOR PISTON PUMP

BACKGROUND OF THE INVENTION

1. Field of the Invention

The present invention relates to a piston pump, especially to a piston pump that is adapted for handheld tools such as a clamping tool.

2. Description of the Prior Arts

A conventional piston pump has an oil storage bag, a driving assembly, and a piston. The driving assembly drains oil from the oil storage bag and then pressurizes the oil to push and move the piston.

Once the piston pushes against an object to be squeezed during its movement, pressure of a hydraulic oil in the piston increases gradually along with the squeezing movement. When the pressure of the oil reaches a predetermined value, which indicates that the piston has squeezed to a required extent, a safety valve is pushed and opened by the pressurized hydraulic oil, and then the hydraulic oil will flow through a safety channel and return to the oil storage bag.

However, at the moment the safety valve is opened, the pressure of the hydraulic oil will be instantaneously released to zero, so the safety valve is only opened for a moment and will instantly close again as the pressure returns to zero, and therefore the hydraulic oil actually passes through the safety valve and returns to the oil storage bag from the safety channel in only very small amount. At this time, it is necessary to further press an oil returning lever to open the hydraulic oil return channel. However, a user must keep pressing the oil returning lever until all the hydraulic oil flows back from the oil return channel into the oil storage bag, which is inconvenient to do so.

To overcome the shortcomings, the present invention provides a driving pump and a clamping tool to mitigate or obviate the aforementioned problems.

SUMMARY OF THE INVENTION

The main objective of the present invention is to provide an automatic oil return structure that automatically returns all the hydraulic oil back to the oil storage container when the pressure of the hydraulic oil reaches a predetermined value.

The automatic oil return structure includes an oil storage container, a piston, and a main body assembly. The piston is spaced apart from the oil storage container and includes an oil storage chamber. The main body assembly is mounted between the oil storage container and the piston. The main body assembly includes at least one main channel, at least one oil-plug channel, at least one oil blocking assembly, a pressure regulating channel, a controlling channel, a block controlling assembly, a communicating channel, an operating channel, a controlling assembly, a minor channel, and an oil returning channel. The at least one main channel communicates with the oil storage container. The at least one main channel communicates with the oil storage chamber of the piston via the at least one oil-plug channel. The at least one oil blocking assembly is mounted in the at least one oil-plug channel and selectively blocks the at least one oil-plug channel. The pressure regulating channel communicates with the at least one main channel. The controlling channel communicates with the pressure regulating channel.

The block controlling assembly is mounted in the controlling channel and selectively blocks the controlling channel. The communicating channel communicates with the controlling channel. The operating channel communicates with the communicating channel. The controlling assembly is mounted in the operating channel, and selectively blocking the operating channel. The at least one main channel communicates with the operating channel via the minor channel. The oil returning channel communicates with the oil storage container, the operating channel, and the at least one oil-plug channel.

When a pressure of the at least one main channel is larger than a starting pressure, the pressure of the at least one main channel makes the at least one oil blocking assembly open, such that the at least one main channel communicates with the oil storage chamber of the piston; at the same time, the at least one oil blocking assembly isolates the oil storage chamber of the piston from the oil returning channel; at the same time, the block controlling assembly blocks the controlling channel and thereby isolates the pressure regulating channel from the communicating channel; at the same time, the controlling assembly blocks the operating channel and thereby isolates the oil returning channel from the minor channel.

When the pressure of the at least one main channel reaches a limited pressure, the pressure of the at least one main channel pushes the block controlling assembly away thereby the pressure regulating channel communicates with the communicating channel, and pushes the controlling assembly away thereby the minor channel communicates with the oil returning channel; at the same time, a pressure of the oil storage chamber of the piston pushes the at least one oil blocking assembly to isolate the oil storage chamber of the piston from the at least one main channel, and then the oil storage chamber of the piston communicates with the oil returning channel; the limited pressure is larger than the starting pressure.

As a result, when the pressure of the main channel reaches the limited pressure, the pressure is capable of pushing the controlling assembly away and thereby the main channel, the controlling assembly, and the oil returning channel communicate with one another, which decreases the pressure of the main channel. At the same time, the oil blocking assembly moves to isolate the main channel from the oil-plug channel, which also makes the oil storage chamber of the piston communicate with the oil returning channel, such that the oil storage chamber of the piston is capable of keeping retuning the hydraulic oil.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
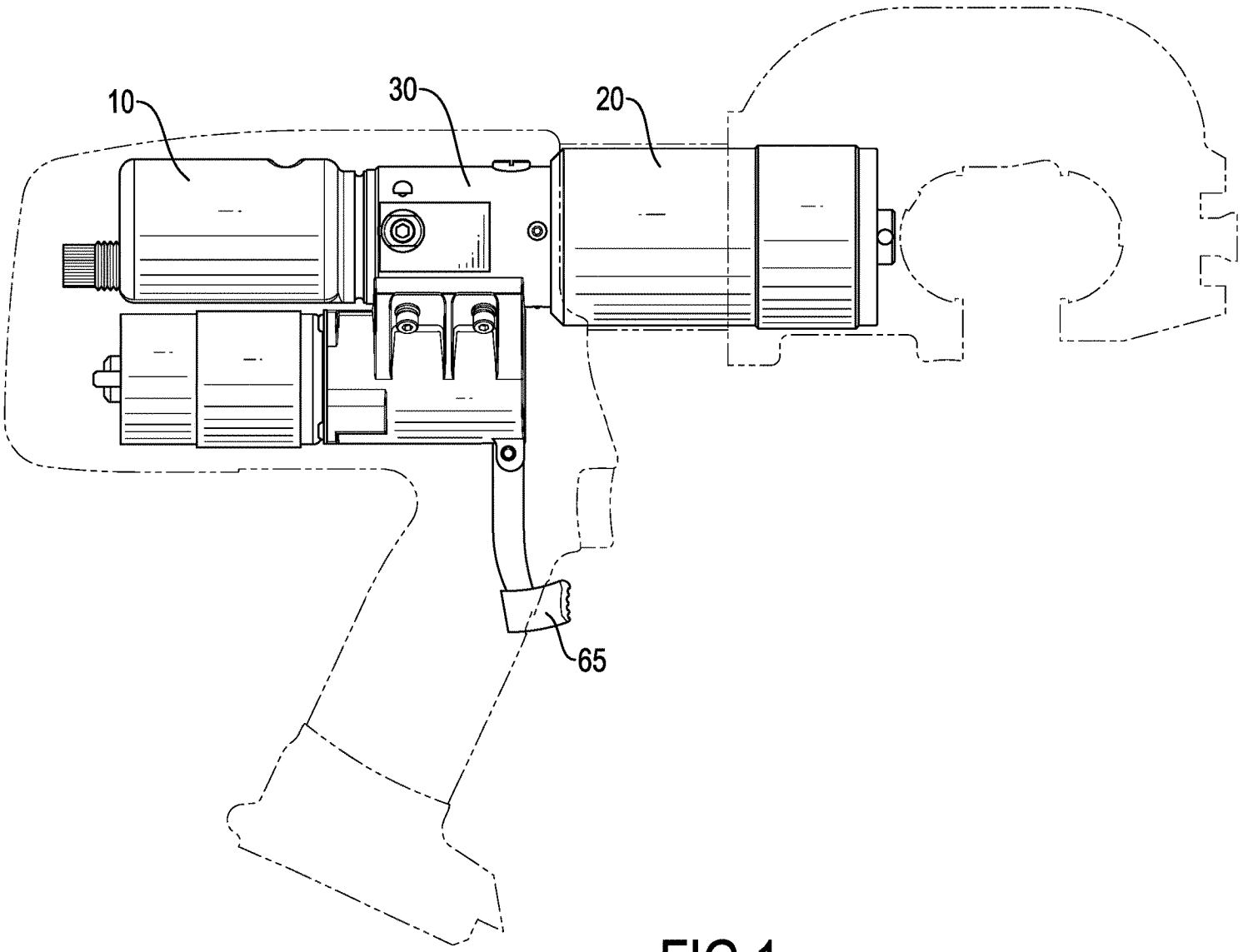
FIG. 1 is a side view of an automatic oil return structure for a piston pump in accordance with the present invention, which is mounted in a clamping tool.
Figure 2:
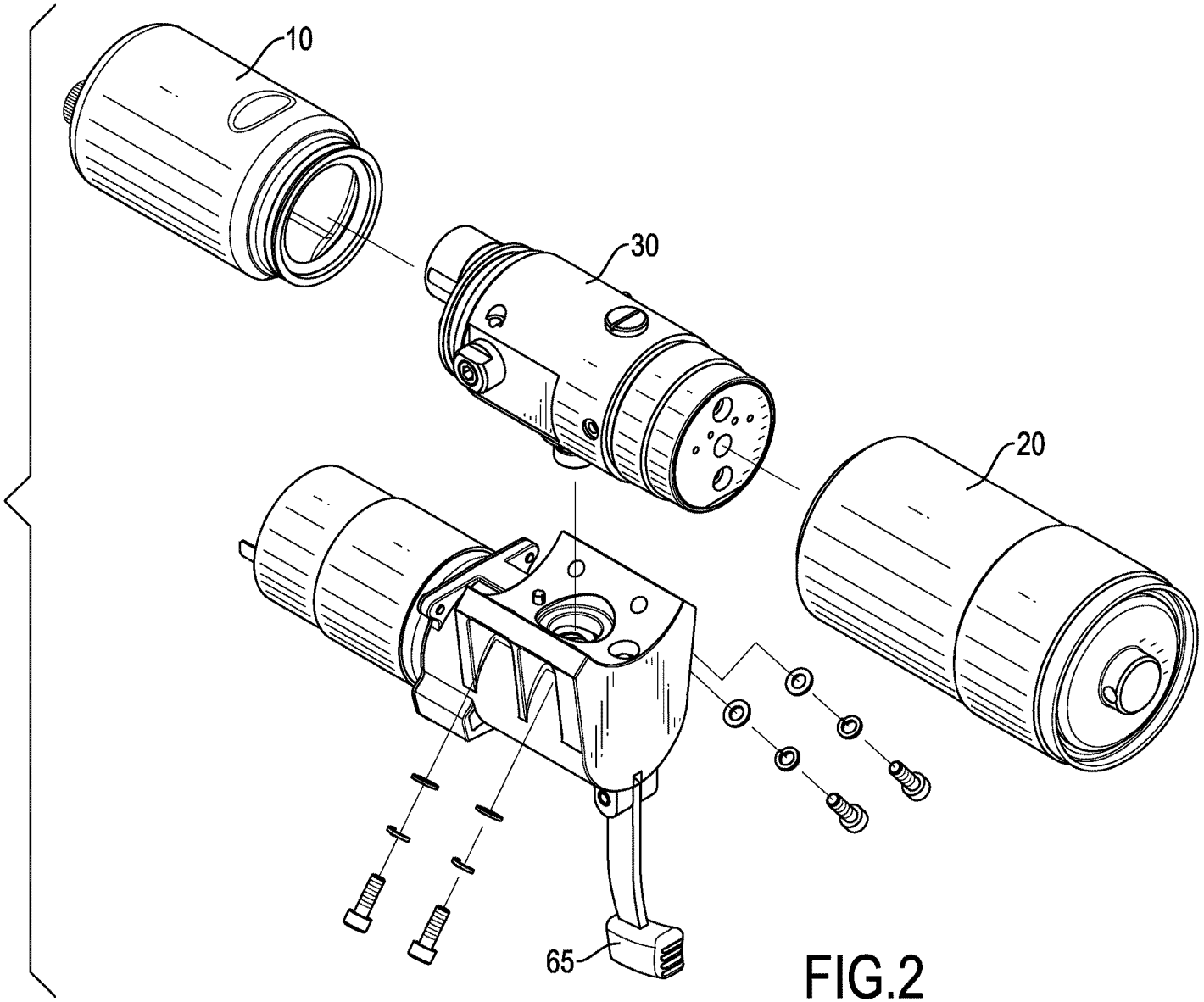
FIG. 2 is an exploded view of the automatic oil return structure in FIG. 1.
Figure 3:
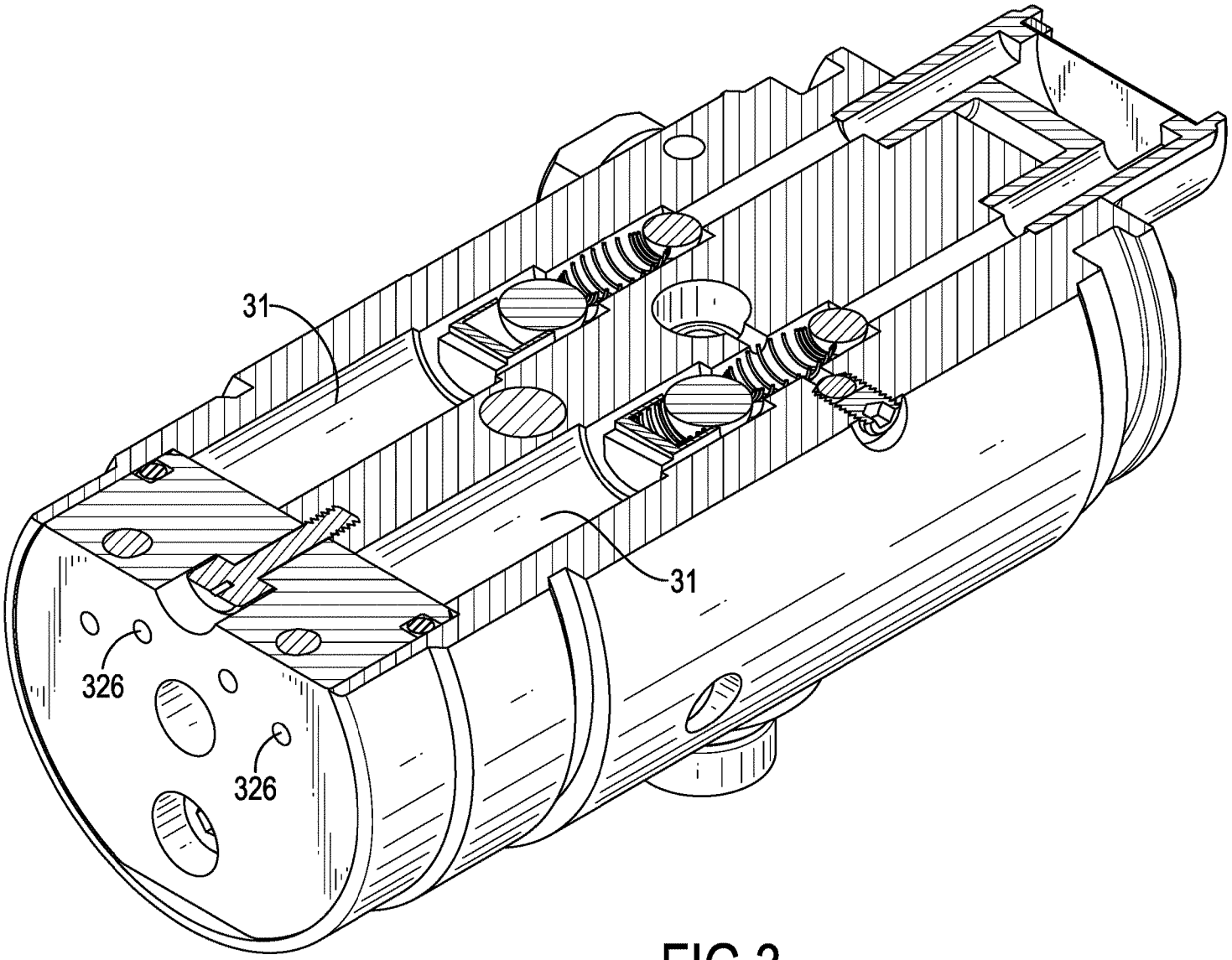
FIG. 3 is a sectional view of a main channel of a main body assembly of the automatic oil return structure in FIG. 1.
Figure 4:
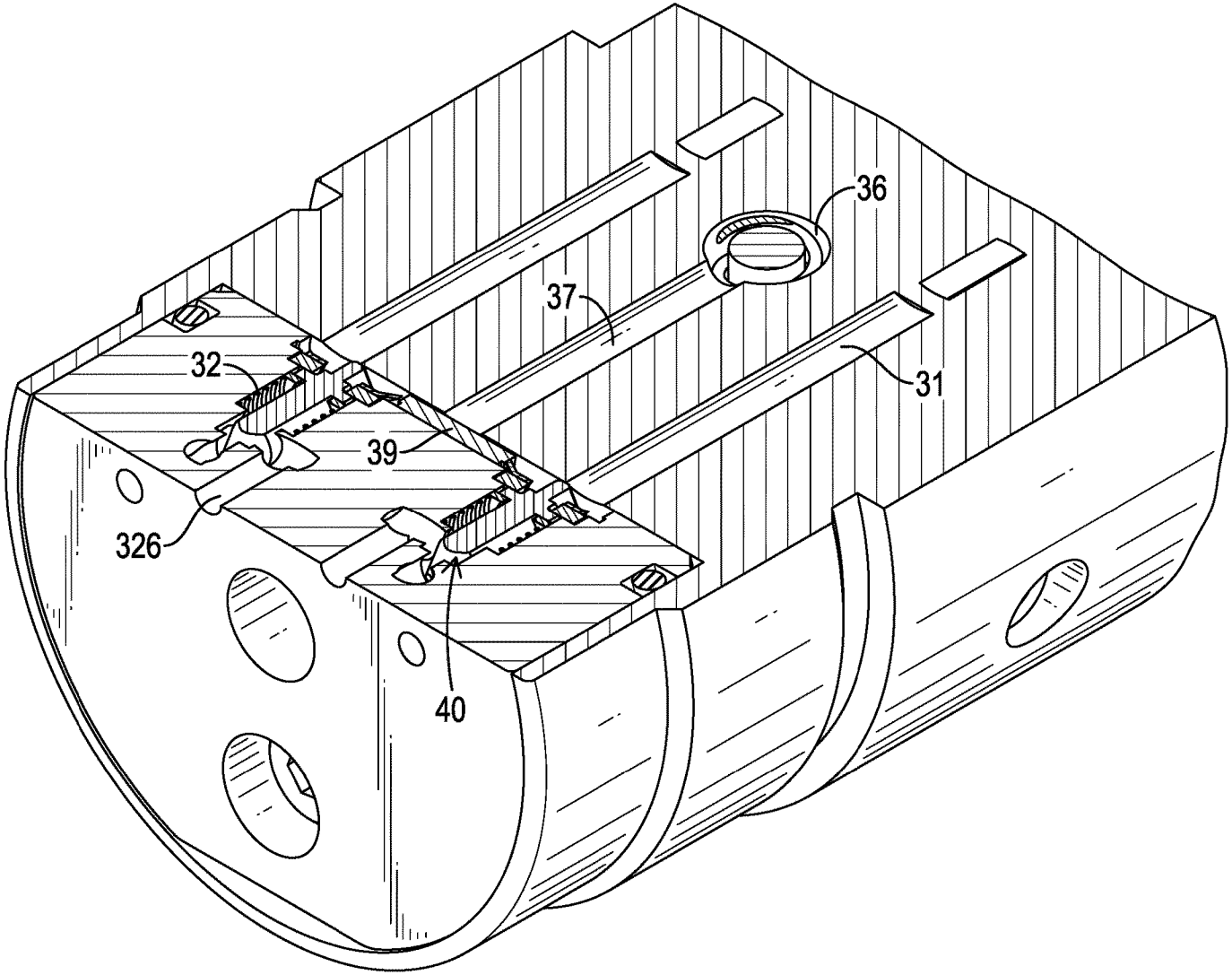
FIG. 4 is a sectional view of an oil-plug channel of the main body assembly of the automatic oil return structure in FIG. 1.

With reference to FIG. 1 and FIG. 2, an automatic oil return structure for a piston pump in accordance with the present invention is provided. The automatic oil return structure includes an oil storage container 10, a piston 20, and a main body assembly 30. The hydraulic oil is stored in the oil storage container 10, and the hydraulic oil is pumped into an oil storage chamber of the piston 20 by the main body assembly 30 such that the piston 20 is pushed and moved. Therefore, in this embodiment, the oil storage container 10 and the piston 20 are disposed separately with the main body assembly 30 mounted between the storage container 10 and the piston 20.

With reference to FIGS. 3 to 6, the main body assembly 30 includes at least one main channel 31, at least one oil-plug channel 32, a pressure regulating channel 33, a controlling channel 34, a communicating channel 35, an operating channel 36, a minor channel 37, an oil returning channel 38, at least one oil blocking assembly 40 mounted in the at least one oil-plug channel 32, a block controlling assembly 50 mounted in the controlling channel 34, and a controlling assembly 60 mounted in the operating channel 36. In this embodiment, the main body assembly 30 selectively includes a communicating chamber 39, and the main channel 31, the oil-plug channel 32, the pressure regulating channel 33, and the minor channel 37 communicate with the communicating chamber 39. Therefore, the main channel 31, the oil-plug channel 32, the pressure regulating channel 33, and the minor channel 37 communicate with each other and maintain the same pressure. In this embodiment, there are two main channels 31, two oil-plug channels 32, and two oil blocking assemblies 40, but the number is not limited. Besides, the number of the main channels 31 may not be equal to the number of the oil-plug channels 32.

In this embodiment, one end of the main channel 31 communicates with the oil storage container 10, and another end communicates with the communicating chamber 39.

With reference to FIGS. 7 to 11, the oil-plug channel 32 communicates with the communicating chamber 39 and the oil storage chamber of the piston 20, therefore the main channel 31 communicates with the oil storage chamber of the piston 20. The two oil blocking assemblies 40 are mounted in the two oil-plug channels 32 respectively. Therefore, the oil blocking assemblies 40 are configured to selectively block the oil-plug channels 32. Each one of the oil-plug channels 32 includes a first opening 321, a first section 322, a second section 323, a second opening 324, and a third section 325 which communicate with each other sequentially. In this embodiment, each one of the oil-plug channels 32 further includes an outlet section 326. The first opening 321 is disposed between the first section 322 and the main channel 31, and thereby the first section 322 communicates with the main channel 31 via the first opening 321. The second section 323 communicates with the oil storage chamber of the piston 20. The second opening is disposed between the second section 323 and the third section 325. The third section 325 communicates with the oil returning channel 38. The two ends of the outlet section 326 communicate with the second section 323 and the oil storage chamber of the piston 20 respectively.

Each one of the oil blocking assemblies 40 includes an oil blocking unit 41, an oil gasket 42, and an oil elastic unit 43. The oil blocking unit 41 is movably mounted in the first section 322 of the oil-plug channel 32, and selectively blocks the first opening 321 of the oil-plug channel 32 or the second opening 324 of the oil-plug channel 32. The oil blocking unit 41 includes an annular protrusion 410 disposed in the first section 322 of the oil-plug channel 32. A gap is formed between an outer peripheral surface of the annular protrusion 410 and an inner peripheral surface of the first section 322. Therefore, the hydraulic oil can pass through the outer peripheral surface of the annular protrusion 410 and the inner peripheral surface of the first section 322.

The oil gasket 42 is disposed in the first section 322 and movably sleeved on the oil blocking unit 41. A gap is formed between an inner peripheral surface of the oil gasket 42 and the oil blocking unit 41, and thereby the hydraulic oil can pass through the inner peripheral surface of the oil gasket 42 and the oil blocking unit 41. Besides, an inner diameter of the oil gasket 42 is smaller than an outer diameter of the annular protrusion 410, an outer peripheral surface of the oil gasket 42 abuts and fits the inner peripheral surface of the first section 322, and the oil gasket 42 selectively abuts the annular protrusion 410 of the oil blocking unit 41. Therefore, when the oil gasket 42 abuts the annular protrusion 410 of the oil blocking unit 41, the gap between the outer peripheral surface of the annular protrusion 410 and the inner peripheral surface of the first section 322 may be blocked by the oil gasket 42, and the gap between the inner peripheral surface of the oil gasket 42 and the oil blocking unit 41 may be blocked by the annular protrusion 410 of the oil blocking unit 41, hence the first section 322 is blocked and the hydraulic oil cannot flow between the two ends of the first section 322.

The oil elastic unit 43 pushes the oil gasket 42 such that the oil gasket 42 is configured to abut the annular protrusion 410 of the oil blocking unit 41.

Figure 5:
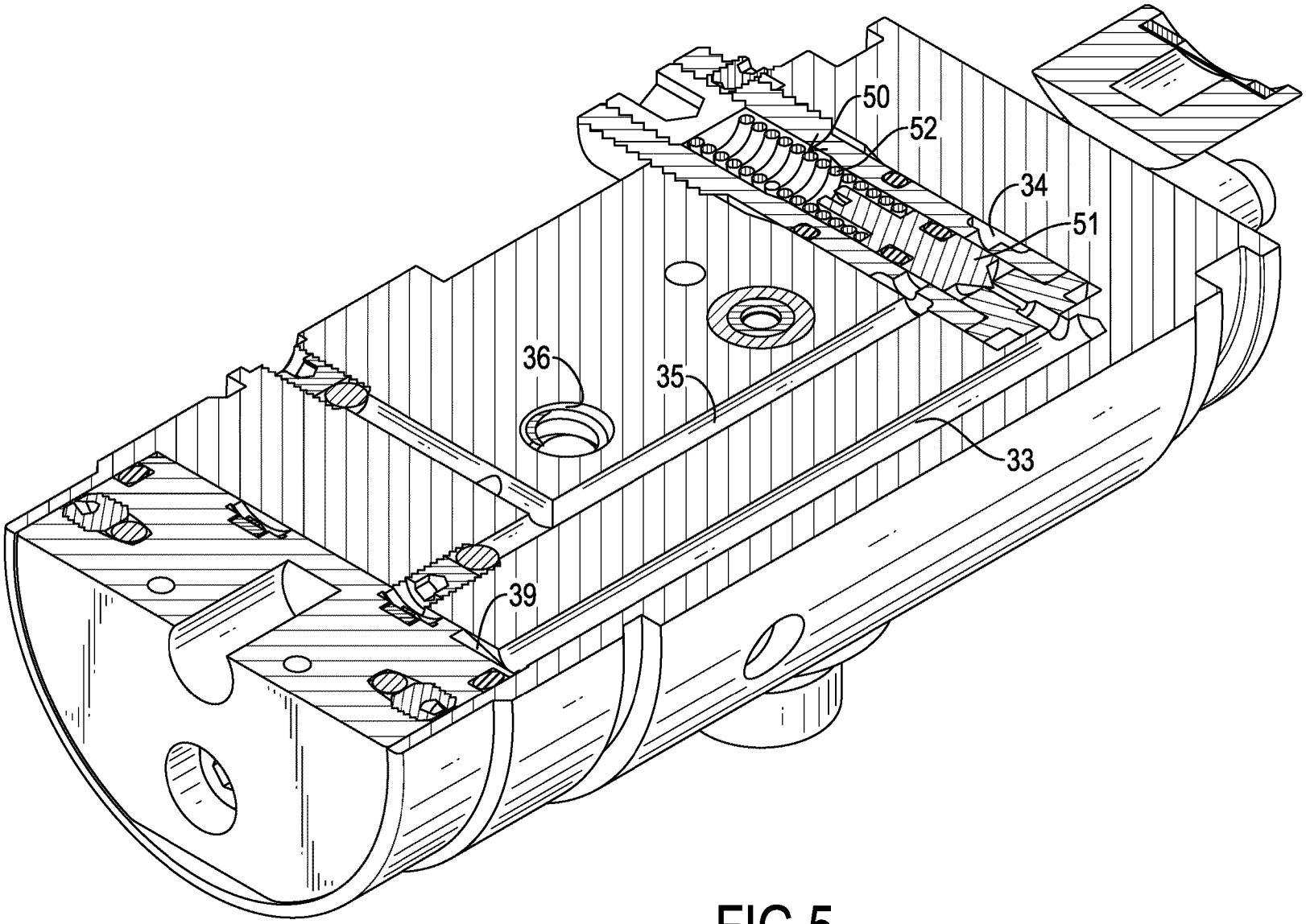
FIG. 5 is a sectional view of a pressure regulating channel, a controlling channel, and a communicating channel of the main body assembly of the automatic oil return structure in FIG. 1.

With reference to FIG. 5, one end of the pressure regulating channel 33 communicates with the main channel 31 via the communicating chamber 39, and another end communicates with the controlling channel 34.

The block controlling assembly 50 is mounted in the controlling channel 34 and selectively blocks the controlling channel 34, which isolates the pressure regulating channel 33 from the communicating channel 35. In this embodiment, the block controlling assembly 50 includes a controlling plug 51 and a controlling elastic unit 52. The controlling plug 51 is movably mounted in the controlling channel 34 and is configured to move between two communicating openings. One of the communicating openings is formed between the controlling channel 34 and the pressure regulating channel 33, and the other communicating opening is formed between the controlling channel 34 and the communicating channel 35. With such structure, the pressure regulating channel 33 is isolated from the communicating channel 35. The controlling elastic unit 52 pushes the controlling plug 51 such that the controlling plug 51 is configured to abut the communicating opening between the controlling channel 34 and the pressure regulating channel 33, and thus the controlling plug 51 is maintained between the two communicating openings.

Figure 12:
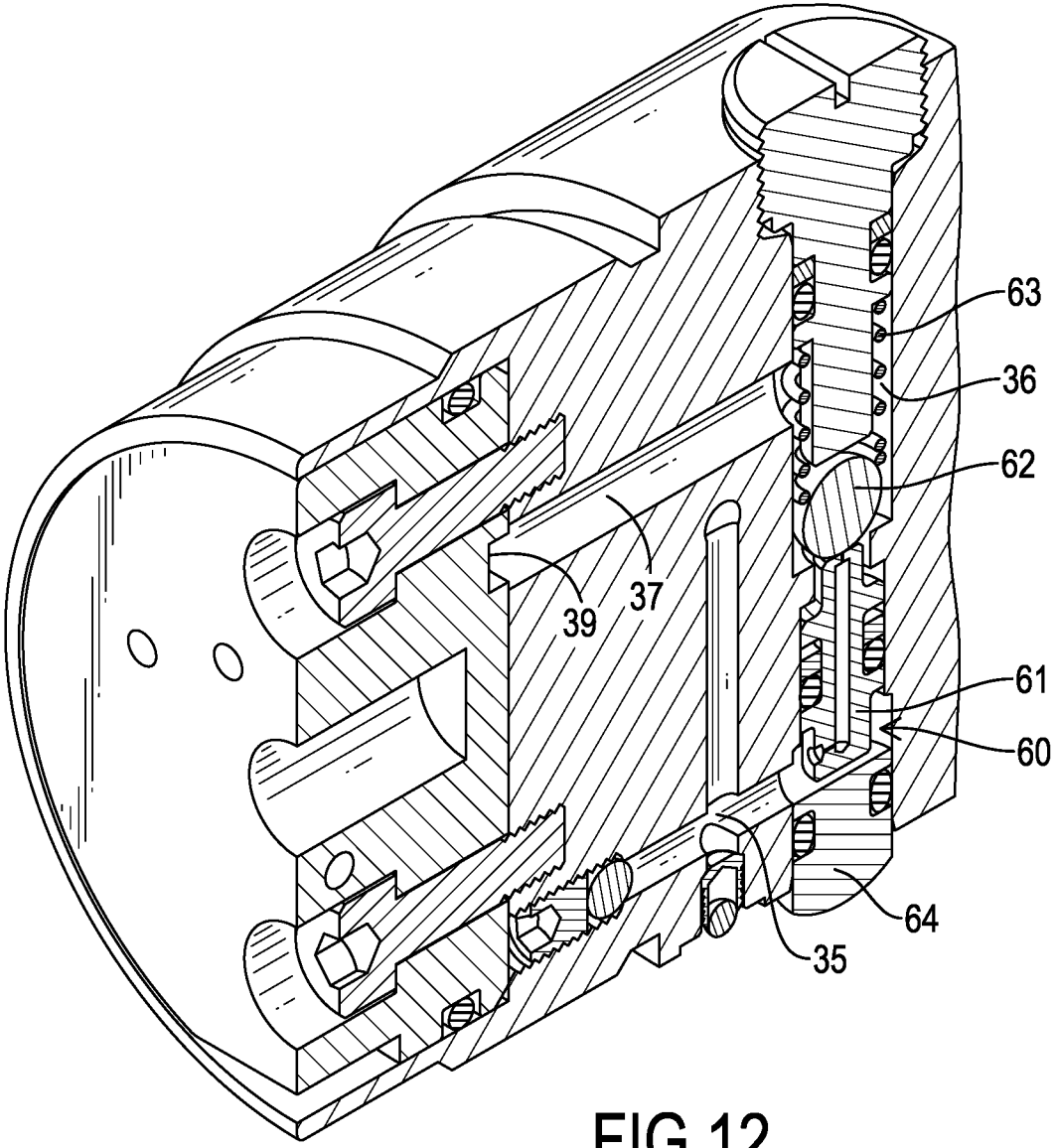
FIG. 12 is a sectional view of a minor channel and an operating channel of the main body assembly of the automatic oil return structure in FIG. 1.
Figure 13:
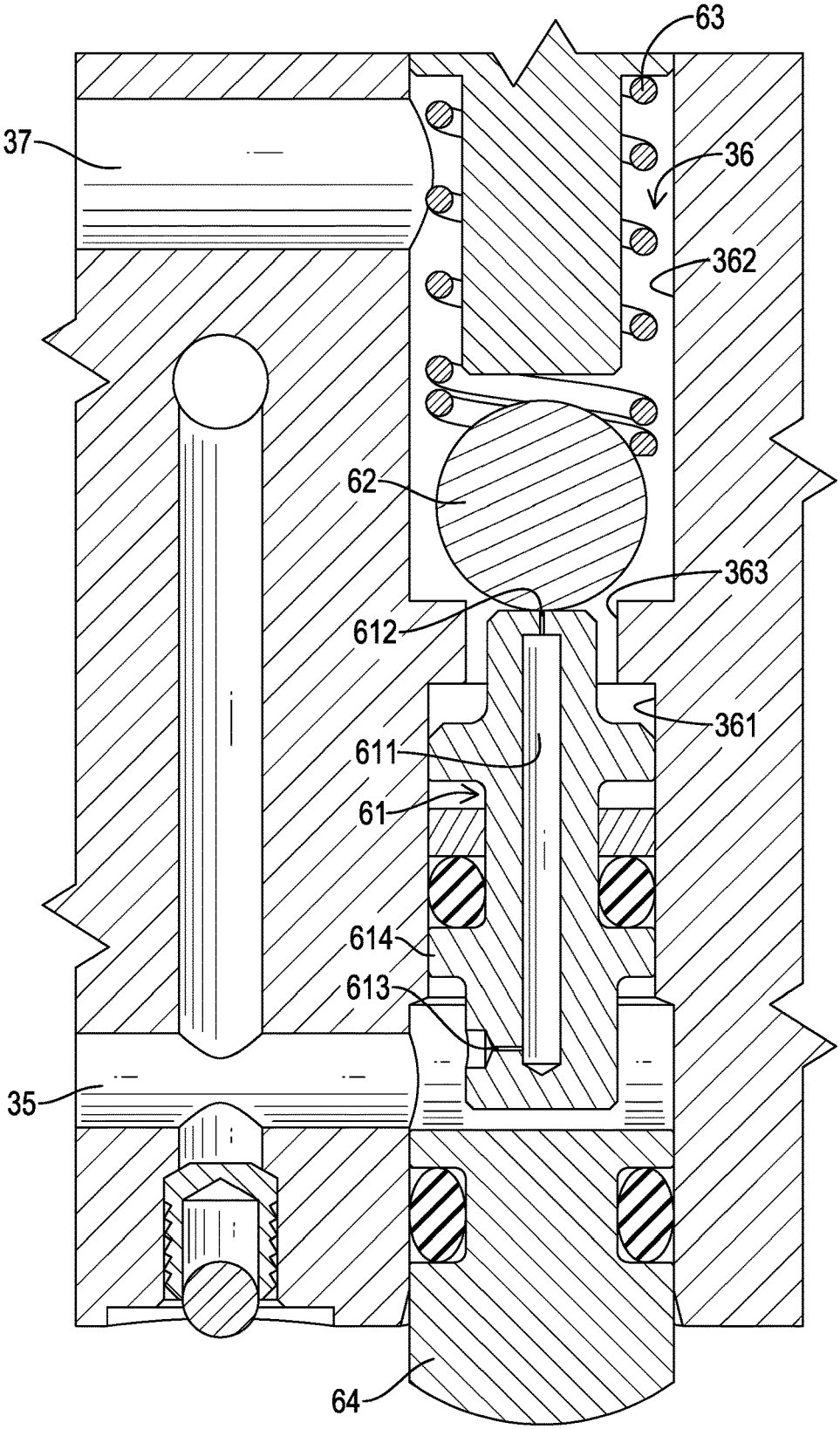
FIGS. 13 and 14 are sectional views of the operating channel and the controlling assembly of the automatic oil return structure in FIG. 1.
Figure 14:
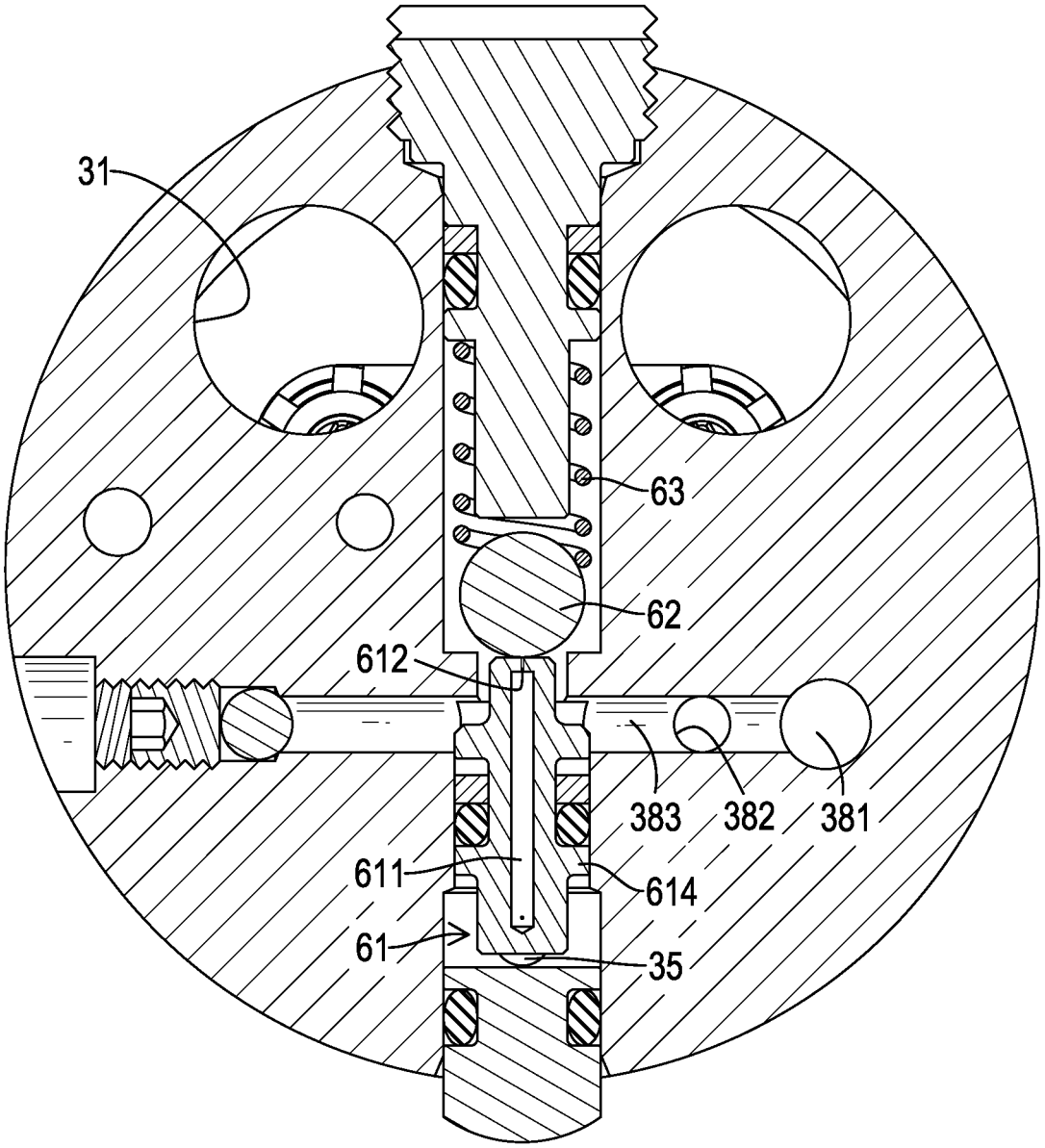

Then please refer to FIG. 12 to FIG. 14. One of the communicating channels 35 communicates with the controlling channel 34, and another end of the communicating channel 35 communicates with the operating channel 36. One end of the minor channel 37 communicates with the main channel 31 via the communicating chamber 39, and another end of the minor channel 37 communicates with the operating channel 36. The oil returning channel 38 communicates with the operating channel 36, the oil storage container 10, and the third section 325 of the oil-plug channel 32.

In this embodiment, the operating channel 36 includes a first operating section 361, a second operating section 362, and a blocking opening 363. The communicating channel 35 communicates with the oil returning channel 38 via the first operating section 361, and the second operating section 362 communicates with the minor channel 37. The blocking opening 363 is located between the first operating section 361 and the second operating section 362 and thereby the first operating section 361 communicates with the second operating section 362.

The controlling assembly 60 is mounted in the operating channel 36 and selectively blocks the operating channel 36. The controlling assembly 60 includes at least one operating plug, an operating elastic unit 63, and a pushing unit 64. The operating plug is mounted in the operating channel 36 and selectively blocks the operating channel 36, and thereby the minor channel 37 is isolated from the oil returning channel 38. The pushing unit 64 is movably and operably mounted in the operating channel 36 and configured to push the operating plug to open the operating channel 36 under a user's operation. Therefore, the minor channel 37 communicates with the oil returning channel 38. The operating elastic unit 63 is configured to push the operating plug such that the operating plug is configured to block the operating channel 36.

In this embodiment, the controlling assembly 60 includes two operating plugs, which are defined as a first operating plug 61 and a second operating plug 62, respectively. The first operating plug 61 is movably mounted in the first operating section 361 and selectively moves and protrudes into the second operating section 362.

The first operating plug 61 includes an inner channel 611, a first opening 612, a second opening 613, and an annular protrusion 614 of the operating plug 61. The inner channel 611 is formed in the first operating plug 61. The first opening 612 may be formed on an end surface of the first operating plug 61 and said end surface is adjacent to the second operating plug 62, but it is not limited thereto. The first opening 612 communicates with the inner channel 611. The second opening 613 communicates with the inner channel 611 and the communicating channel 35. An outer peripheral surface of the annular protrusion 614 abuts and fits on an inner peripheral surface of the first operating section 361 and is located between the first opening 612 and the second opening 613. In other words, in this embodiment, the second opening 613 may communicate with the second opening 613 only via the inner channel 611, instead of via a space out of the first operating plug 61.

The second operating plug 62 is movably mounted in the second operating section 362 and selectively abuts the blocking opening 363. Thus, as the first operating section 361 is isolated from the second operating section 362, thereby the minor channel 37 is isolated from the oil returning channel 38. The operating elastic unit 63 abuts the second operating plug 62 such that the second operating plug 62 is configured to move toward or abut the blocking opening 363.

Moreover, the pushing unit 64 is configured to move the first operating plug 61 to protrude into the second operating section 362 and push away the second operating plug 62 under the user's operation, such that the first operating section 361 communicates with the second operating section 362 and thereby the minor channel communicates with the oil returning channel 38.

Figure 6:
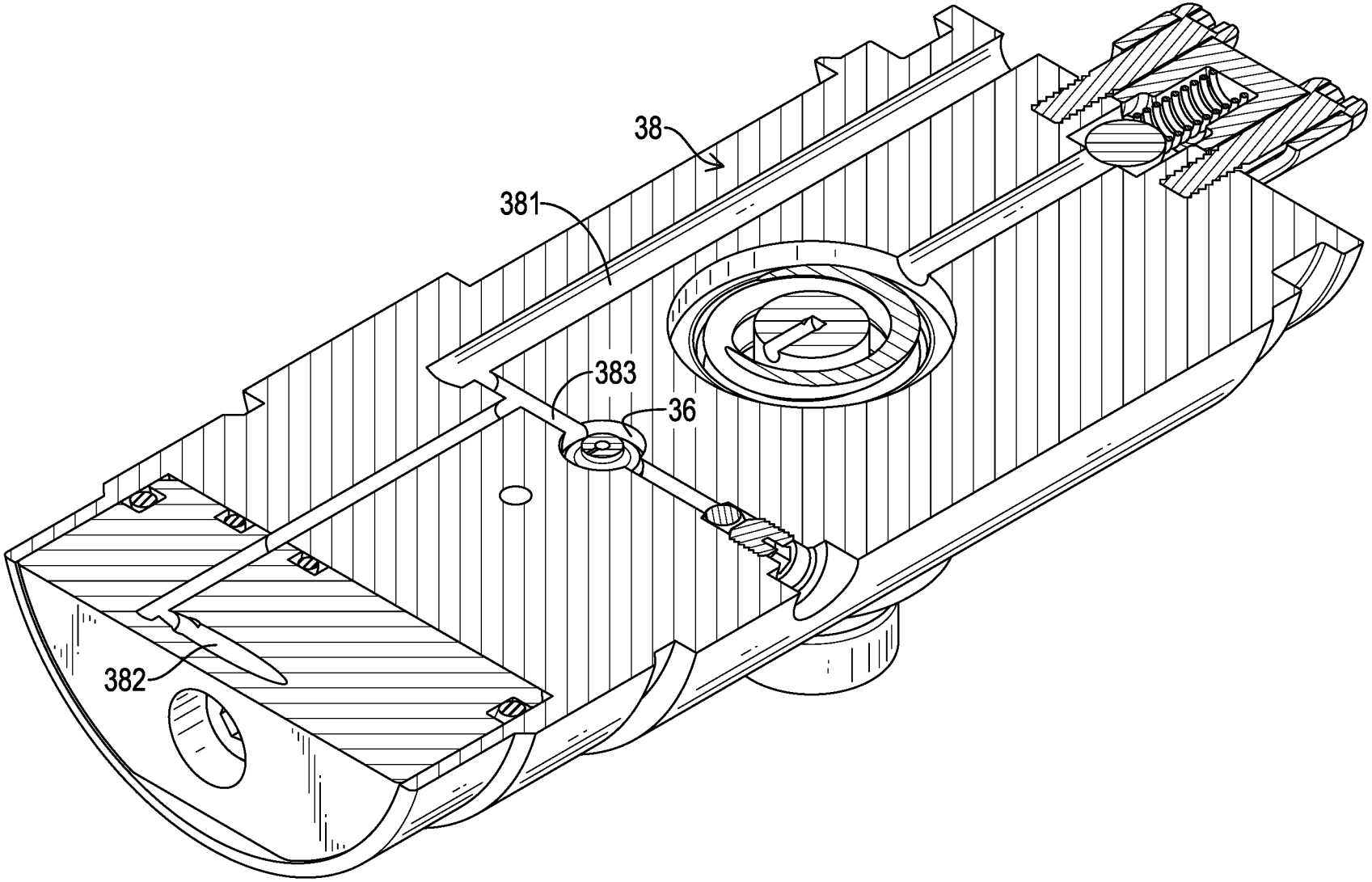
FIG. 6 is a sectional view of an oil returning channel of the main body assembly of the automatic oil return structure in FIG. 1.
Figure 7:
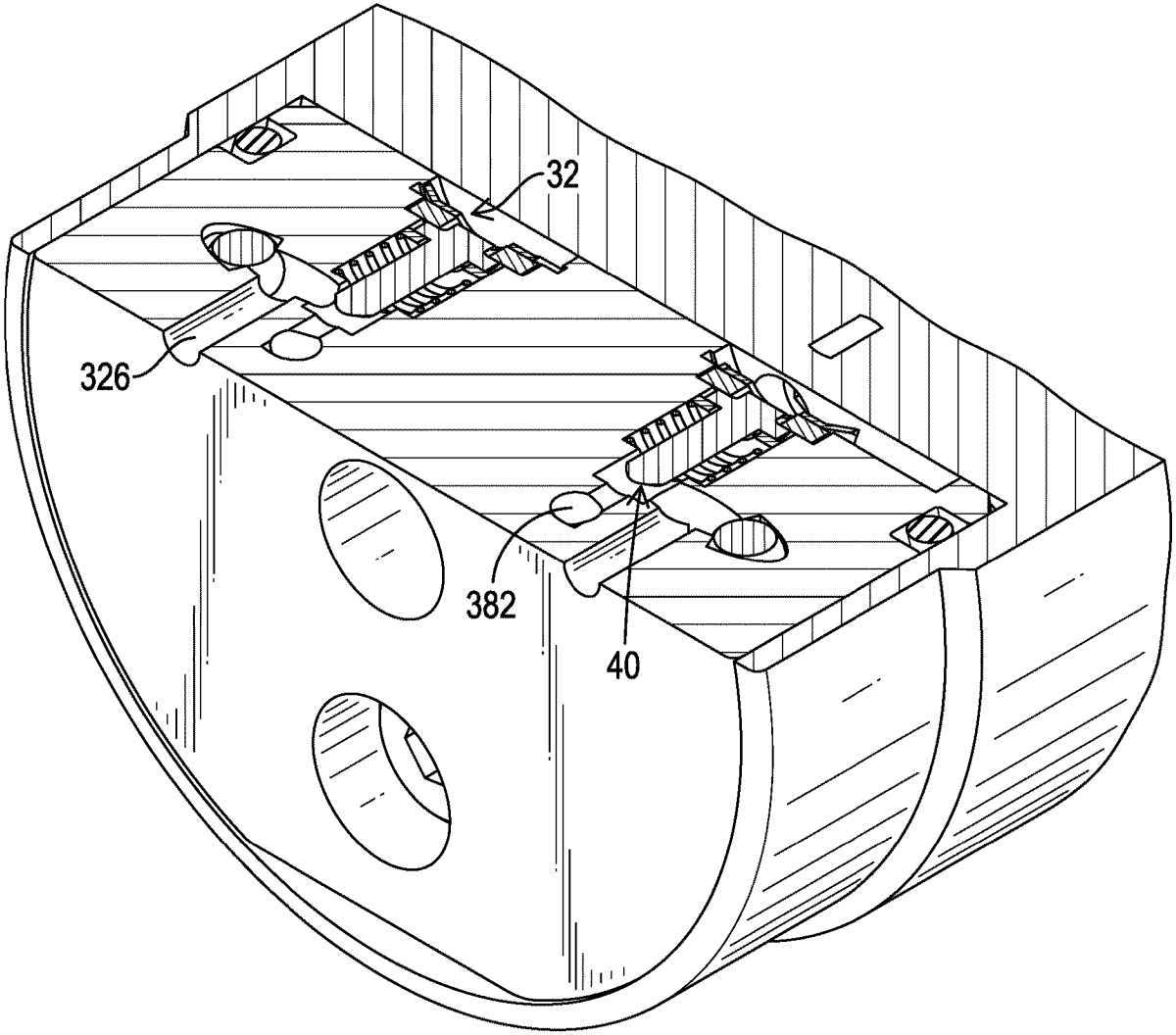
FIGS. 7 to 9 are sectional views of the oil-plug channel of the automatic oil return structure in FIG. 1.
Figure 8:
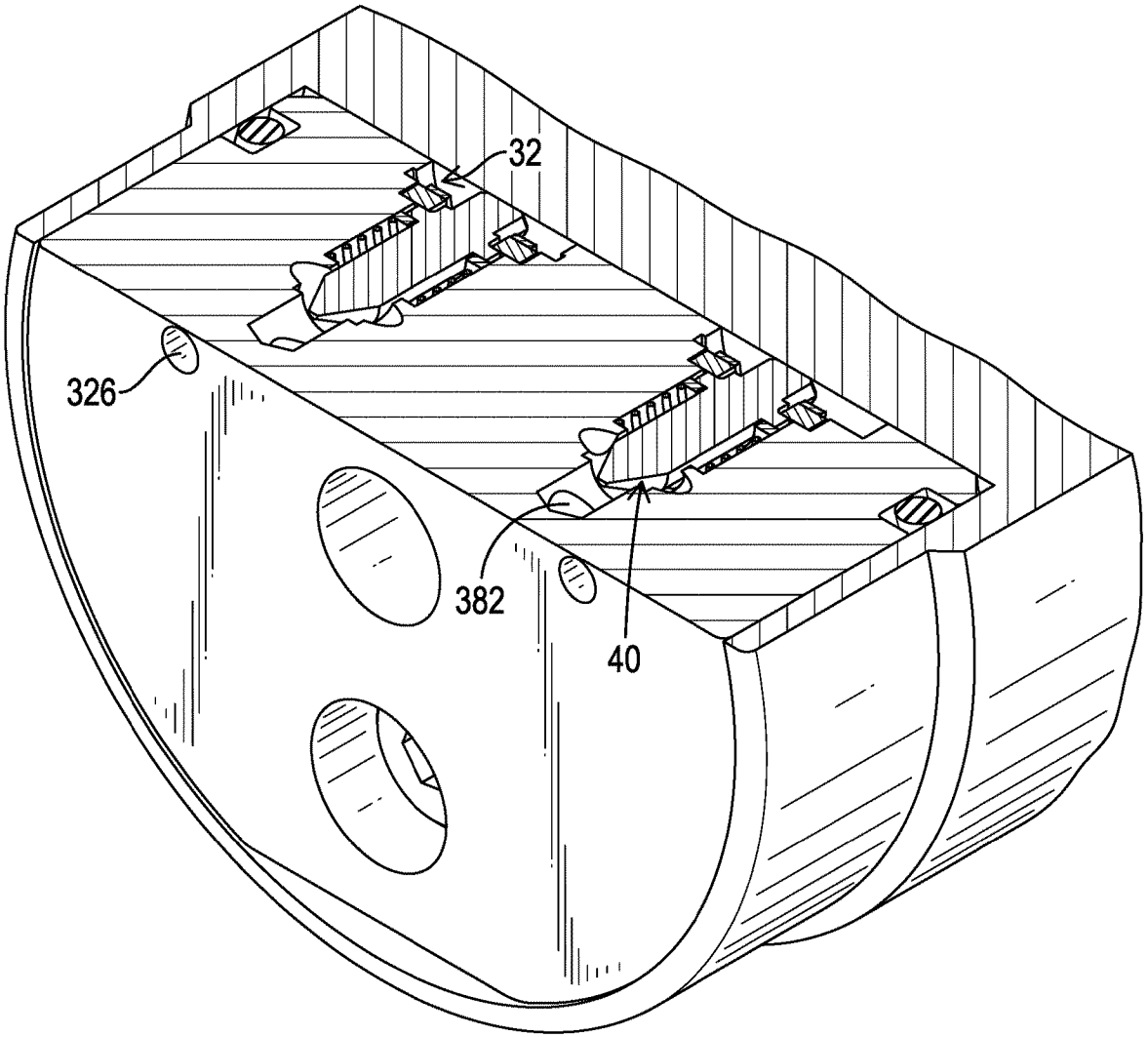
Figure 9:
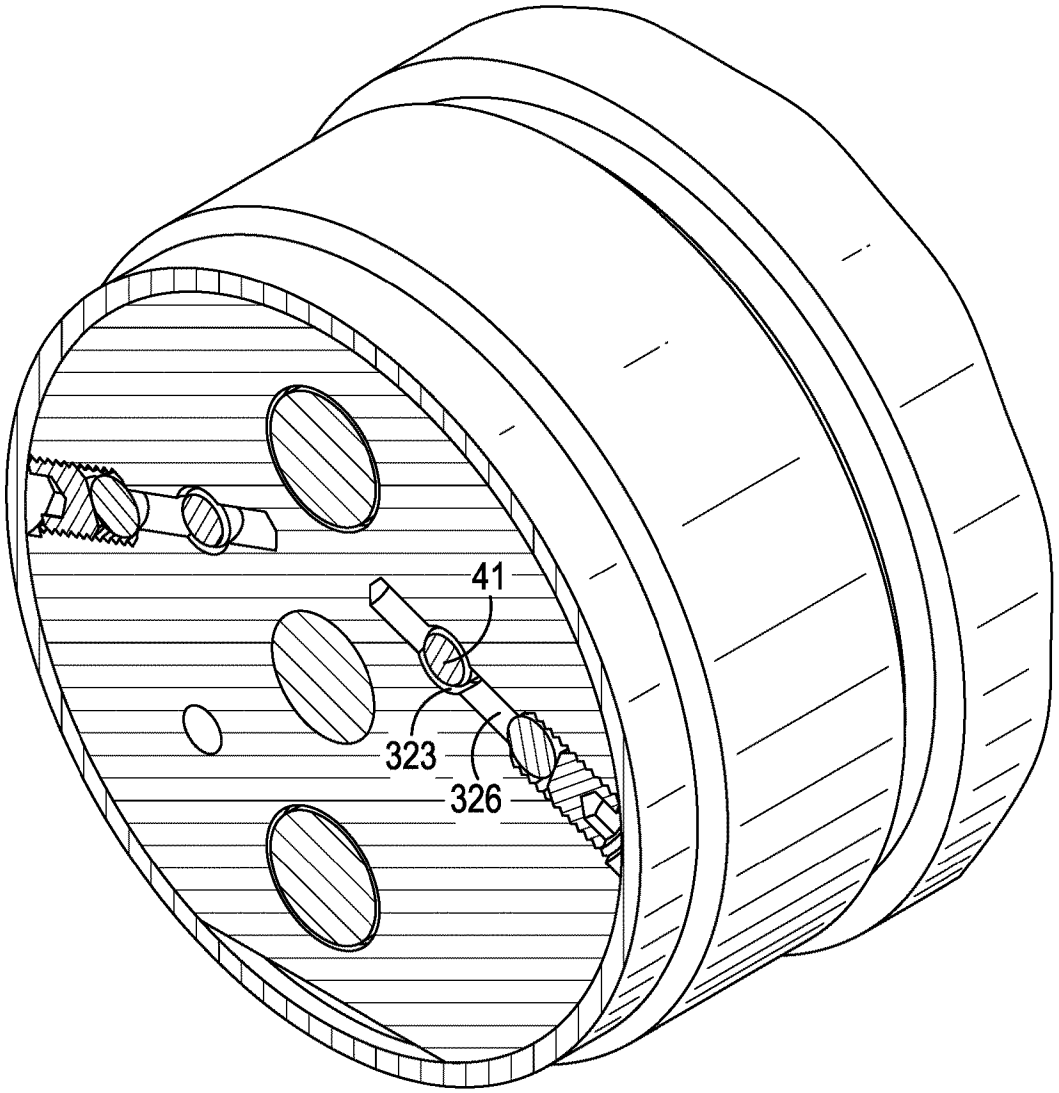
Figure 10:
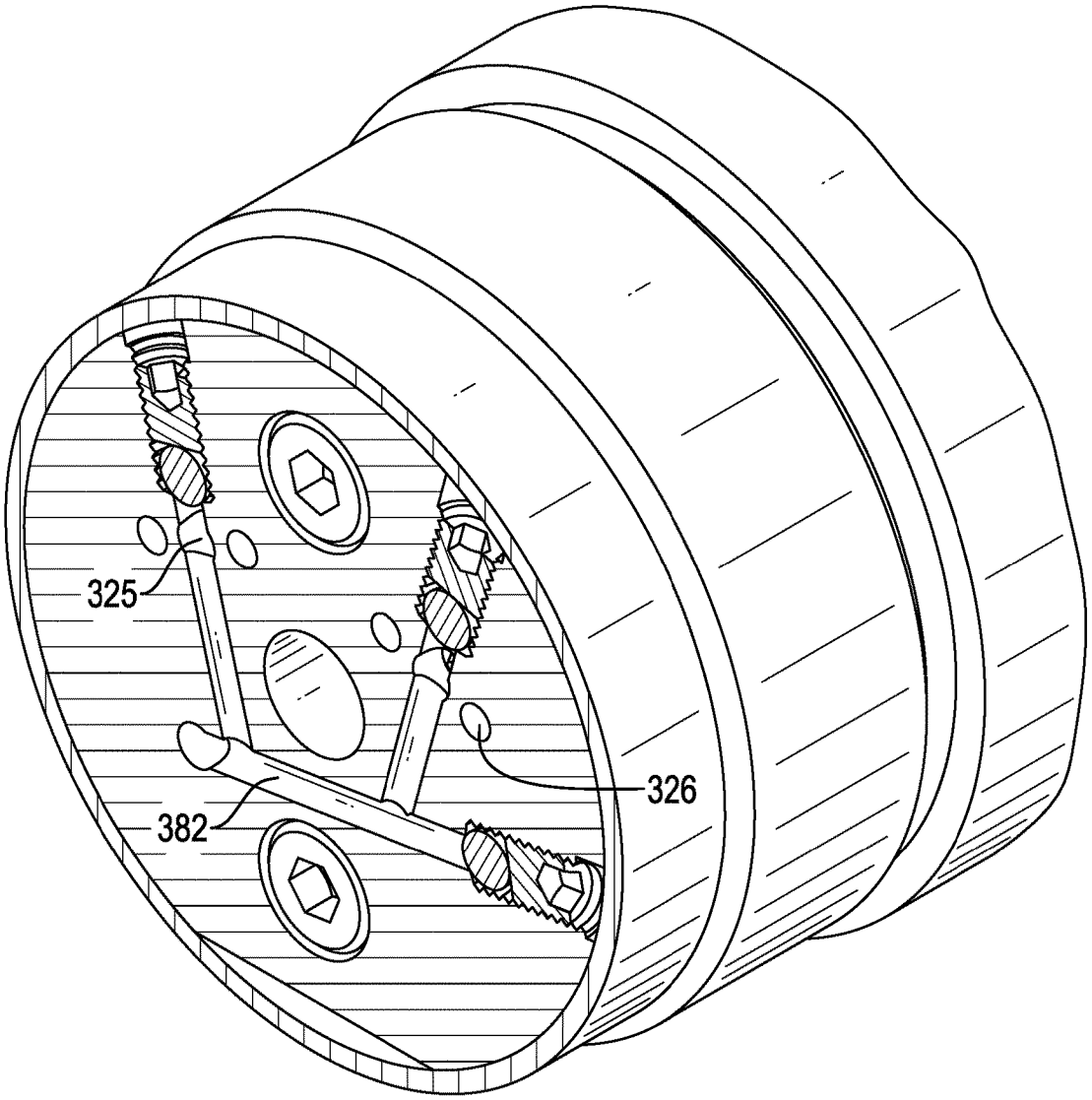
FIG. 10 is another sectional view of the oil returning channel of the automatic oil return structure in FIG. 1.

Then please refer to FIG. 6. The oil returning channel 38 includes an oil returning section 381, an oil releasing section 382, and a communicating section 383. The oil returning section 381 communicates with the oil storage container 10. One end of the oil releasing section 382 communicates with the oil-plug channel 32 and another end of the oil releasing section 382 communicates with the oil returning section 381. One end of the communicating section 383 communicates with the operating channel 36 and another end of the communicating section 383 communicates with the oil returning section 381.

With the aforementioned structures, in the present automatic oil return structure, the hydraulic oil in the oil storage chamber of the piston 20 can be continuously returned and thus a pressure of the oil storage chamber of the piston 20 can be automatically released when the pressure achieves a predetermined value, rather than returning the hydraulic oil in just a moment. Precisely, the returning is continuous until the user operates the piston 20 again or the pressures of the oil storage chamber of the piston 20 and the oil storage container 10 are balanced.

Figure 11:
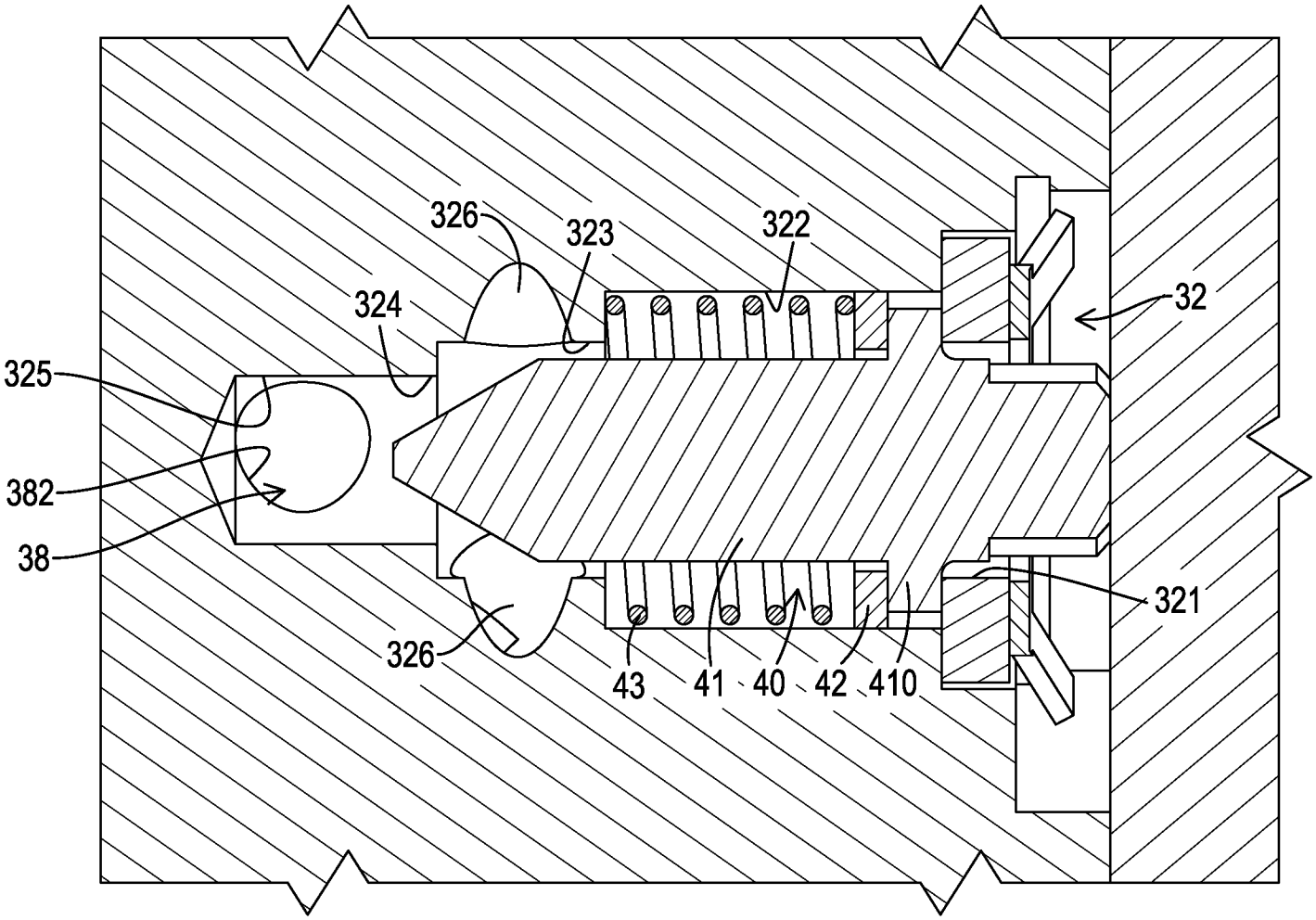
FIG. 11 is a sectional view of an oil blocking assembly of the automatic oil return structure in FIG. 1, shown at an original pressure.

Then please refer to FIG. 5, FIG. 11, and FIG. 13. In the beginning, the pressure of the oil storage chamber of the piston 20 is equal to that of the oil storage container 10, and the block controlling assembly 50 blocks the controlling channel such that the pressure regulating channel 33 is isolated from the communicating channel 35, and the controlling assembly 60 blocks the operating channel 36 such that the oil returning channel 38 is isolated from the minor channel 37. In the meantime, the oil blocking unit 41 blocks the first opening 321 of the oil-plug channel 32 and the oil gasket 42 abuts the annular protrusion 410 of the oil blocking unit 41.

When the user manipulates the piston pump, the main body assembly 30 starts to pump the hydraulic oil from the oil storage container 10 to the oil storage chamber of the piston 20. Precisely, the hydraulic oil in the oil storage container 10 may sequentially flow through the main channel 31, the oil-plug channel 32, and the oil storage chamber of the piston 20. Therefore, pressures of the main channel 31, the oil-plug channel 32, and the oil storage chamber of the piston 20 are equal to each other and keep increasing.

Figure 15:
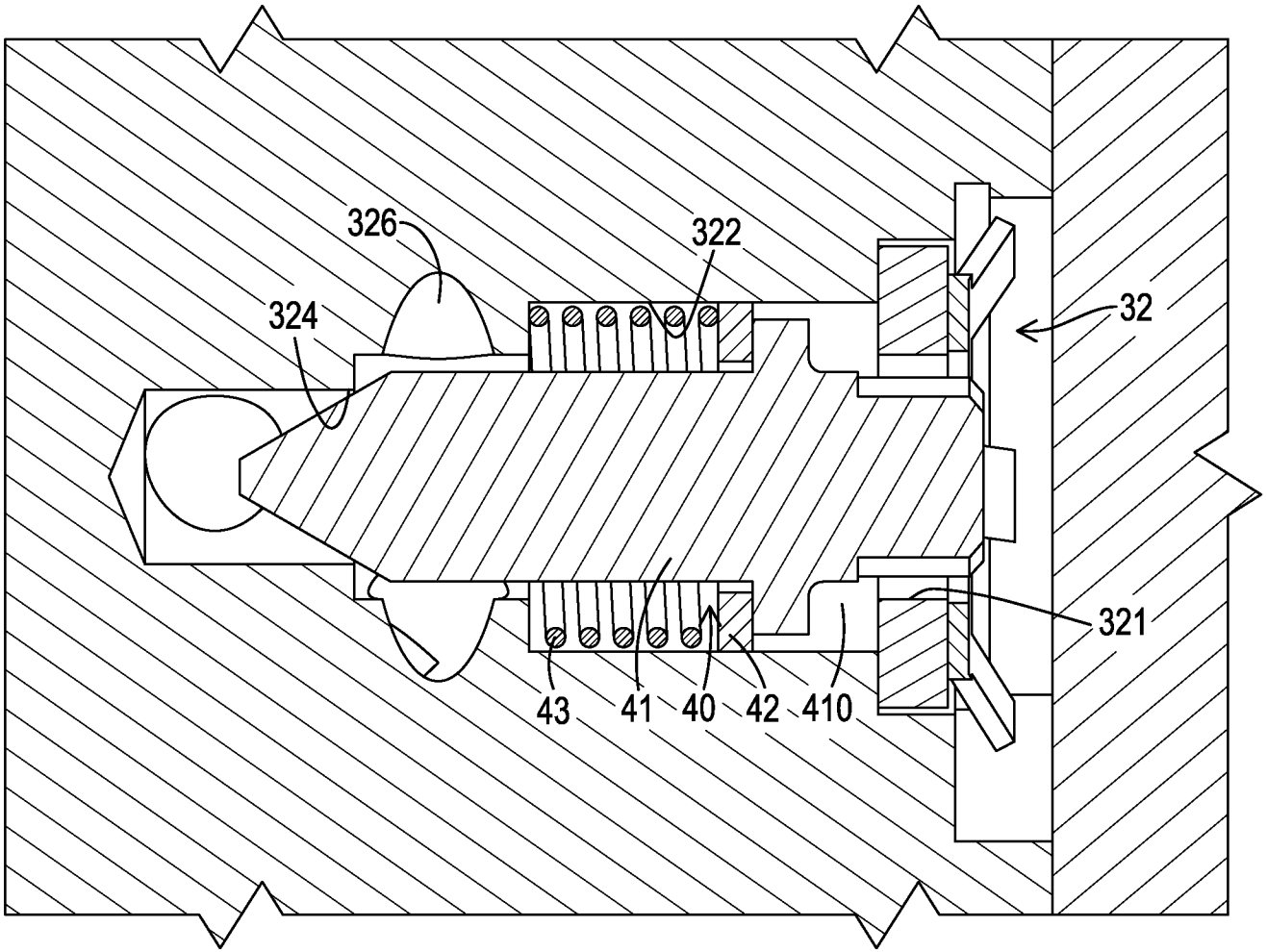
FIG. 15 is a sectional view of the oil blocking assembly of the automatic oil return structure in FIG. 1, shown at an original pressure.
Figure 16:
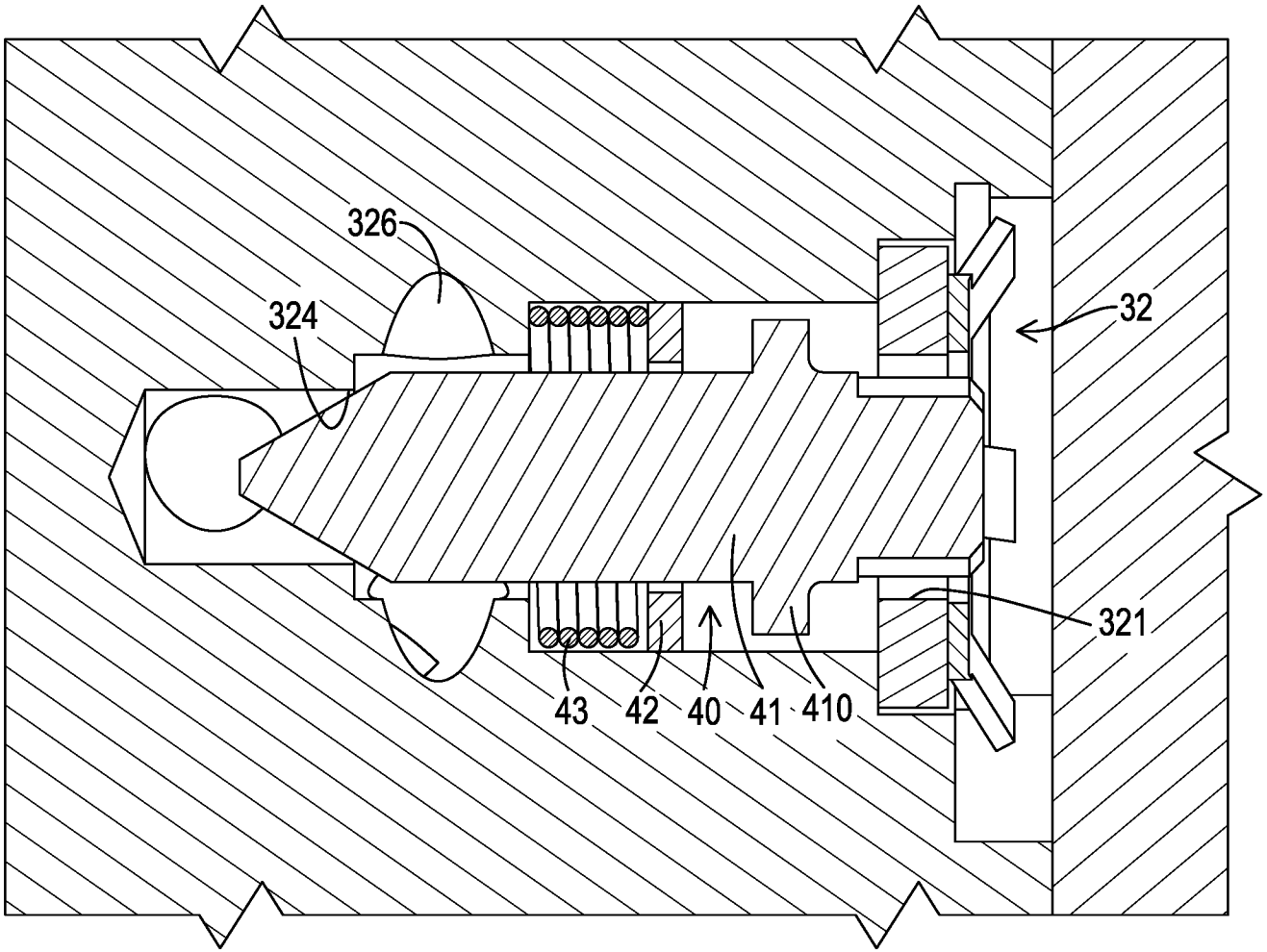
FIG. 16 is a sectional view of the oil blocking assembly of the automatic oil return structure in FIG. 1, shown over the original pressure.

Then please also refer to FIG. 15 and FIG. 16. When the pressure of the main channel 31 achieves a starting pressure, the pressure of the main channel 31 is capable of moving the oil blocking unit 41 to open the first opening 321 and block the second opening 324 of the oil-plug channel 32, and thus the main channel 31 communicates with the first section 322 of the oil-plug channel 32 and the oil storage chamber of the piston 20 is isolated from the oil returning channel 38 at the same time. Then, the pressure of the main channel 31 makes the oil gasket 42 separate from the annular protrusion 410 of the oil blocking unit 41, i.e. the oil blocking assembly 40 and the first section 322 of the oil-plug channel 32 are opened and thereby the main channel 31 communicates with the oil storage chamber of the piston 20. Therefore, the hydraulic oil can flow into the oil storage chamber of the piston 20 and push the piston 20. Meanwhile, the oil blocking unit 41 still keeps blocking the second opening 324 of the oil-plug channel 32 to isolate the oil storage chamber of the piston 20 from the oil returning channel 38, and the pressure of the main channel 31 is not capable of moving the block controlling assembly 50 which blocks the controlling channel 34 or the controlling assembly 60 which blocks the operating channel 36.

When the pressure of the main channel 31 is increased to achieve a limited pressure, the pressure of the piston 20 achieves a maximum pressure under the safety requirement, and thus the automatic oil return structure starts to return the hydraulic oil. Precisely, when the pressure of the main channel 31 achieve the limited pressure, the pressure of both the pressure regulating channel 33 and the minor channel 37 that communicate with the main channel 31 also achieve the limited pressure. Meanwhile, the pressure pushes away the block controlling assembly 50 and the pressure regulating channel 33 communicates with the communicating channel 35, and thereby a pressure of the communicating channel 35 also achieves the limited pressure. Then, the pressure pushes away the controlling assembly 60 and the minor channel 37 communicates with the oil returning channel 38. Precisely, if the pressure of the main channel 31 is smaller than the limited pressure, the second operating plug 62 of the controlling assembly 60 abuts the blocking opening 363 of the operating channel 36. Even if the pressures of the main channel 31 and the communicating channel 35 achieve the limited pressure, the hydraulic oil can hardly flow from the communicating channel 35 to the inner channel 611 because a diameter of the second opening 613 is much smaller than that of the communicating channel 35, which makes the hydraulic oil still capable of pushing the first operating plug 61 to move and protrude into the second operating section 362 and push away the second operating plug 62. Therefore, the blocking opening 363 is open and thus the minor channel 37 communicates with the oil returning channel 38.

Because a pressure of the oil storage container 10 is always kept at the lowest original pressure and the oil returning channel 38 communicates with the oil storage container 10, the pressure of the oil returning channel 38 is also kept at the lowest original pressure. When the minor channel 37 communicates with the oil returning channel 38, the pressures of the main channel 31, the oil-plug channel 32, the pressure regulating channel 33, and the minor channel 37 may decrease to the original pressure. However, at this moment, the pressure of the oil storage chamber of the piston 20 is still at the limited pressure, so the pressure may push the oil blocking unit 41 of the oil blocking assembly 40 to block the first opening 321 of the oil-plug channel 32 and the oil gasket 42 abuts the annular protrusion 410 of the oil blocking unit 41. In other words, the oil blocking assembly 40 isolates the oil storage chamber of the piston 20 from the main channel 31, so the hydraulic oil may not flow back to the main channel 31. At the same time, the oil storage chamber of the piston 20 communicates with the oil returning channel 38, so the hydraulic oil may flow back to the oil storage container 10 via the oil returning channel 38.

Only when the user operates and thus the pressure of the main channel 31 increases again, the oil blocking assembly 40 may keep isolating the oil storage chamber of the piston 20 from the main channel 31 but the oil storage chamber of the piston 20 communicates with the oil returning channel 38. Therefore, the hydraulic oil can continuously flow back to the oil storage container 10 until the pressures of the oil storage chamber of the piston 20 and the oil storage container 10 are balanced.

Besides, the user may take the initiative to return the hydraulic oil before the pressure of the main channel 31 achieves the limited pressure. Precisely, the user may press a pressure releasing button 65 which is linked with the pushing unit 64 of the controlling assembly 60, then the pushing unit 64 may push the first operating plug 61 to protrude into the second operating section 362 and the second operating plug 62 is pushed away. Thus, the minor channel 37 communicates with the oil returning channel 38. When the minor channel 37 communicates with the oil returning channel 38, the result is the same as the aforesaid automatic oil return process, i.e., the oil blocking assembly 40 isolates the oil storage chamber of the piston 20 from the main channel 31 but the oil storage chamber of the piston 20 communicates with the oil returning channel 38. Therefore, the hydraulic oil may flow back to the oil storage container 10 via the oil returning channel 38.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An automatic oil return structure for a piston pump comprising:
- an oil storage container;
- a piston spaced apart from the oil storage container and comprising:
  - an oil storage chamber;
- a main body assembly mounted between the oil storage container and the piston and comprising:
  - at least one main channel communicating with the oil storage container;
  - at least one oil-plug channel, the at least one main channel communicating with the oil storage chamber of the piston via the at least one oil-plug channel;
  - at least one oil blocking assembly mounted in the at least one oil-plug channel and selectively blocking the at least one oil-plug channel;
  - a pressure regulating channel communicating with the at least one main channel;
  - a controlling channel communicating with the pressure regulating channel;
  - a block controlling assembly mounted in the controlling channel and selectively blocking the controlling channel;

a communicating channel communicating with the controlling channel;

an operating channel communicating with the communicating channel;

a controlling assembly mounted in the operating channel, and selectively blocking the operating channel;

a minor channel, the at least one main channel communicating with the operating channel via the minor channel;

an oil returning channel communicating with the oil storage container, the operating channel, and the at least one oil-plug channel;

wherein when a pressure of the at least one main channel is larger than a starting pressure, the pressure of the at least one main channel makes the at least one oil blocking assembly open, such that the at least one main channel communicates with the oil storage chamber of the piston; at the same time, the at least one oil blocking assembly isolates the oil storage chamber of the piston from the oil returning channel; at the same time, the block controlling assembly blocks the controlling channel and thereby isolates the pressure regulating channel from the communicating channel; at the same time, the controlling assembly blocks the operating channel and thereby isolates the oil returning channel from the minor channel;

when the pressure of the at least one main channel achieves a limited pressure, the pressure of the at least one main channel pushes the block controlling assembly away and thereby the pressure regulating channel communicates with the communicating channel, and pushes the controlling assembly away and thereby the minor channel communicates with the oil returning channel; at the same time, a pressure of the oil storage chamber of the piston pushes the at least one oil blocking assembly to isolate the oil storage chamber of the piston from the at least one main channel, and then the oil storage chamber of the piston communicates with the oil returning channel; the limited pressure is larger than the starting pressure.

2. The automatic oil return structure as claimed in claim 1, wherein the main body assembly comprises:

a communicating chamber, each one of the at least one main channel, the at least one oil-plug channel, the pressure regulating channel, and the minor channel communicates with the communicating chamber and thereby the at least one oil-plug channel, the pressure regulating channel, and the minor channel communicate with each other.

3. The automatic oil return structure as claimed in claim 1, wherein:

each one of the at least one oil-plug channel includes a first opening, a first section, a second section, a second opening, and a third section communicating with each other subsequently; the first opening is located between the first section and the at least one main channel, such that the first section communicates with the at least one main channel; the second section communicates with the oil storage chamber of the piston; the second opening is located between the second section and the third section; the third section communicates with the oil returning channel;

each one of the at least one oil blocking assembly comprises:

an oil blocking unit movably mounted in the at least one oil-plug channel and selectively blocking the first opening of the at least one oil-plug channel or blocking the second opening of the at least one oil-plug channel; the oil blocking unit comprising:

an annular protrusion located in the first section, a gap formed between an outer peripheral surface of the annular protrusion of the oil blocking unit and an inner peripheral surface of the first section;

an oil gasket mounted in the first section and movably sleeved on the oil blocking unit, an outer peripheral surface of the oil gasket attached to the inner peripheral surface of the first section, a gap formed between an inner peripheral surface of the oil gasket and the oil blocking unit; an inner diameter of the oil gasket being smaller than an outer diameter of the annular protrusion of the oil blocking unit, such that the oil gasket selectively abuts the annular protrusion of the oil blocking unit, and when the oil gasket abuts the annular protrusion of the oil blocking unit, the first section is blocked; and an oil elastic unit pushing the oil gasket such that the oil gasket is configured to abut the annular protrusion of the oil blocking unit;

wherein when the pressure of the at least one main channel is smaller than the starting pressure, the oil blocking unit blocks the first opening of the at least one oil-plug channel, and the oil gasket abuts the annular protrusion of the oil blocking unit;

when the pressure of the at least one main channel is larger than the starting pressure, the pressure of the at least one main channel pushes the oil blocking unit to move and open the first opening of the at least one oil-plug channel and thereby blocks the second opening of the at least one oil-plug channel, and then the at least one main channel communicates with the first section and the oil storage chamber of the piston is isolated from the oil returning channel; then, the pressure of the at least one main channel pushes the oil gasket to separate from the annular protrusion of the oil blocking unit and open the first section, such that the at least one main channel communicates with the oil storage chamber of the piston;

when the pressure of the at least one main channel achieves the limited pressure, the oil blocking unit is moved to block the first opening of the at least one oil-plug channel and open the second opening of the at least one oil-plug channel, and thereby the oil storage chamber of the piston communicates with the oil returning channel.

4. The automatic oil return structure as claimed in claim 3, wherein:

the at least one main channel includes two said main channels;

the at least one oil-plug channel includes two said oil-plug channels; and the at least one oil blocking assembly includes two said oil blocking assemblies.

5. The automatic oil return structure as claimed in claim 4, wherein the oil returning channel comprises:

an oil returning section communicating with the oil storage container;

an oil releasing section, the at least one oil-plug channel communicating with the oil returning section via the oil releasing section; and a communicating section, one end of the communicating section communicating with the operating channel and another end of communicating section communicating with the oil returning section.

6. The automatic oil return structure as claimed in claim 5, wherein:

the operating channel comprises:

a first operating section, the communicating channel communicating with the oil returning channel via the first operating section;

a second operating section, the first operating section communicating with the minor channel via the second operating section; and a blocking opening located between the first operating section and the second operating section;

the controlling assembly comprises:

a first operating plug movably mounted in the first operating section and selectively protruding out of the first operating section and into the second operating section;

a second operating plug movably mounted in the second operating section and selectively abutting the blocking opening and thereby isolating the first operating section from the second operating section; and an operating elastic unit pushing the second operating plug such that the second operating plug is configured to abut the blocking opening;

wherein when the pressure of the at least one main channel is smaller than the limited pressure, the second operating plug abuts the blocking opening;

when the pressure of the at least one main channel achieves the limited pressure, the first operating plug is moved to protrude into the second operating section and push the second operating plug away and thereby the minor channel communicates with the oil returning channel.

7. The automatic oil return structure as claimed in claim 6, wherein the first operating plug comprises:

an inner channel formed in the first operating plug;

a first opening formed at an end surface of the first operating plug and said end surface being adjacent to the second operating plug, the first opening communicating with the inner channel;

a second opening communicating with the inner channel and communicating with the communicating channel; and an annular protrusion, an outer peripheral surface of the annular protrusion of the first operating plug fit with an inner peripheral surface of the first operating section, and located between the first opening and the second opening.

8. The automatic oil return structure as claimed in claim 7, wherein the controlling assembly comprises:

a pushing unit movably and operably mounted in the operating channel and configured to push the operating plug to protrude into the second operating section and push the second operating plug away and thereby the minor channel communicates with the oil returning channel.

9. The automatic oil return structure as claimed in claim 8, wherein each one of the at least one oil-plug channel includes:

two outlet sections communicating with the oil storage chamber of the piston.

10. The automatic oil return structure as claimed in claim 5, wherein the controlling assembly comprises:

an operating plug selectively blocking the operating channel and thereby isolating the minor channel from the oil returning channel; and a pushing unit movably and operably mounted in the operating channel and configured to push the operating plug to open the operating channel, and thereby the minor channel communicates with the oil returning channel.

11. The automatic oil return structure as claimed in claim 1, wherein:

the at least one main channel includes two said main channels;

the at least one oil-plug channel includes two said oil-plug channels; and the at least one oil blocking assembly includes two said oil blocking assemblies.

12. The automatic oil return structure as claimed in claim 1, wherein the oil returning channel comprises:

an oil returning section communicating with the oil storage container;

an oil releasing section, the at least one oil-plug channel communicating with the oil returning section via the oil releasing section; and a communicating section, one end of the communicating section communicating with the operating channel and another end of communicating section communicating with the oil returning section.

13. The automatic oil return structure as claimed in claim 1, wherein:

the operating channel comprises:

a first operating section, the communicating channel communicating with the oil returning channel via the first operating section;

a second operating section, the first operating section communicating with the minor channel via the second operating section; and a blocking opening located between the first operating section and the second operating section;

the controlling assembly comprises:

a first operating plug movably mounted in the first operating section and selectively protruding out of the first operating section and into the second operating section;

a second operating plug movably mounted in the second operating section and selectively abutting the blocking opening and thereby isolating the first operating section from the second operating section; and an operating elastic unit pushing the second operating plug such that the second operating plug is configured to abut the blocking opening;

wherein when the pressure of the at least one main channel is smaller than the limited pressure, the second operating plug abuts the blocking opening;

when the pressure of the at least one main channel achieves the limited pressure, the first operating plug is moved to protrude into the second operating section and push the second operating plug away and thereby the minor channel communicates with the oil returning channel.

14. The automatic oil return structure as claimed in claim 13, wherein the first operating plug comprises:

an inner channel formed in the first operating plug;

a first opening formed at an end surface of the first operating plug and said end surface being adjacent to the second operating plug, the first opening communicating with the inner channel;

a second opening communicating with the inner channel and communicating with the communicating channel; and an annular protrusion, an outer peripheral surface of the annular protrusion of the first operating plug fit with an inner peripheral surface of the first operating section, and located between the first opening and the second opening.

15. The automatic oil return structure as claimed claim 13, wherein the controlling assembly comprises:

a pushing unit movably and operably mounted in the operating channel and configured to push the operating plug to protrude into the second operating section and push the second operating plug away and thereby the minor channel communicates with the oil returning channel.

16. The automatic oil return structure as claimed in claim 1, wherein the controlling assembly comprises:

an operating plug selectively blocking the operating channel and thereby isolating the minor channel from the oil returning channel; and a pushing unit movably and operably mounted in the operating channel and configured to push the operating plug to open the operating channel, and thereby the minor channel communicates with the oil returning channel.

17. The automatic oil return structure as claimed in claim 1, wherein each one of the at least one oil-plug channel includes:

two outlet sections communicating with the oil storage chamber of the piston.

* * * * *